US005168680A

United States Patent [19]

Matlock

[11] Patent Number: 5,168,680

[45] Date of Patent: Dec. 8, 1992

[54] TELESCOPING TOWER LOCK

[75] Inventor: Jeffrey D. Matlock, Clemmons, N.C.

[73] Assignee: Ingersoll-Rand Company, Woodcliff Lake, N.J.

[21] Appl. No.: 610,695

[22] Filed: Nov. 8, 1990

[51] Int. Cl.[5] ..... B66C 23/06

[52] U.S. Cl. ..... 52/118; 52/117

[58] Field of Search ..... 52/118, 143, 546, 117

[56] References Cited

U.S. PATENT DOCUMENTS

| | | | |
|---|---|---|---|
| 504,987 | 9/1893 | Marum | 52/118 |
| 2,508,835 | 5/1950 | Moon et al. | 52/118 |
| 2,800,206 | 7/1957 | Thorpe | 52/118 |
| 2,905,280 | 9/1959 | Weaver | 52/118 |
| 3,546,831 | 12/1970 | Romo et al. | 52/118 |
| 3,738,075 | 6/1973 | Nansel | 52/118 |
| 4,118,907 | 10/1978 | Small et al. | 52/118 |
| 4,932,176 | 6/1990 | Roberts et al. | 52/118 |

*Primary Examiner*—David A. Scherbel
*Assistant Examiner*—Joanne C. Downs
*Attorney, Agent, or Firm*—Glenn B. Foster

[57] ABSTRACT

An apparatus comprising a telescoping tower which has a first tubular tower member and a second tubular tower member which are relatively telescoped between an extended position and a retracted position. A first aperture is formed in the first tubular tower member. A second aperture is formed in the second tubular tower member, the second aperture being aligned with the first aperture when the tower is in the retracted position. A lock is inserted into the first and second apertures when the tower is in the retracted position, the lock limits relative displacement of the first and the second tubular tower members. The lock consists of a rod which is affixed to a vehicle. The tower is pivotally attached to the vehicle. When the tower is pivoted into a stored position, the lock will be inserted into the aligned apertures.

14 Claims, 2 Drawing Sheets

TELESCOPING TOWER LOCK

BACKGROUND OF THE INVENTION

This invention relates generally to telescoping towers and more particularly to locks which restrict the telescoping tower from telescoping when the tower is in a stored position. Telescoping towers of this type are often used to support lights, machinery or the like.

Telescoping towers which are affixed to vehicles often have hydraulic, pneumatic or mechanical [wire] actuator systems to extend and retract the towers. These actuator systems are often used to maintain the tower in a retracted position when the tower is stored and while the vehicle is being transported.

During transportation of the prior art towers, a failure of the actuator may allow the tower to be free to extend incontrollably from the retracted position.

The foregoing illustrates limitations known to exist in present telescoping towers. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus comprising a telescoping tower having a first tubular tower member and a second tubular tower member which are relatively displaceable between an extended position and a retracted position. A first aperture is formed in the first tubular tower member. A second aperture is formed in the second tubular tower member, the second aperture being aligned with the first aperture when the tower is in the retracted position. Lock means are inserted in said first and second aligned apertures for limiting relative displacement of the first and the second tubular tower members.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
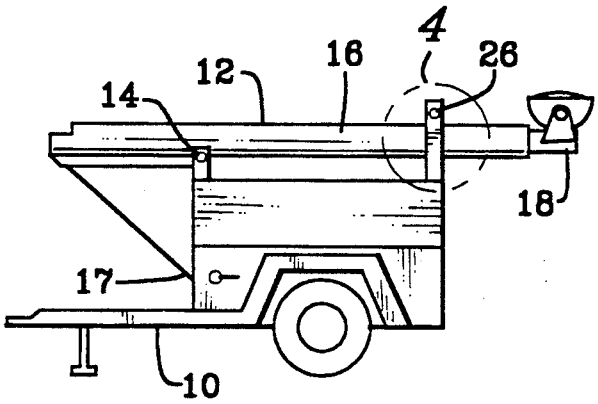
FIG. 1 is a side elevational view illustrating an embodiment of a vehicle with a telescoping tower and tower lock of the instant invention, with the tower in a stored position.
Figure 2:
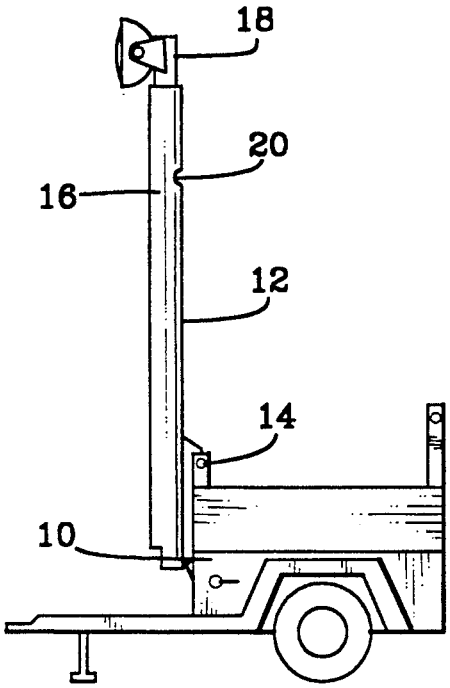
FIG. 2 is a view similar to FIG. 1, with the tower in a usable and telescopically retracted position.
Figure 3:
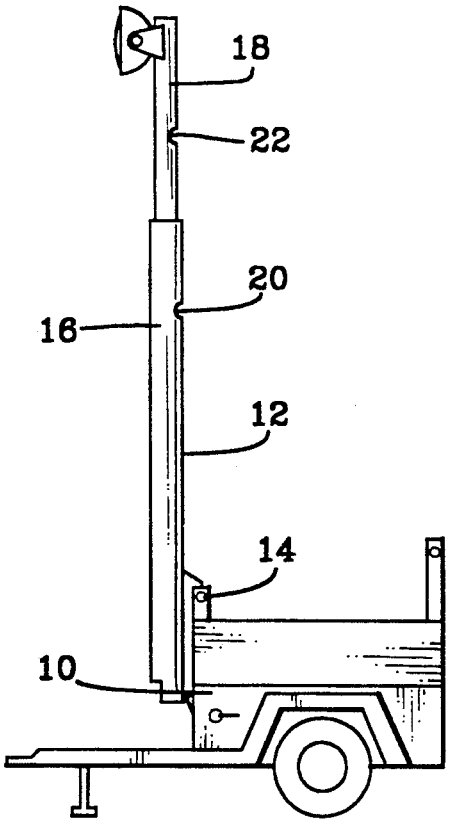
FIG. 3 is a view similar to FIG. 1 with the tower in the usable and, telescopically extended position.
Figure 4:
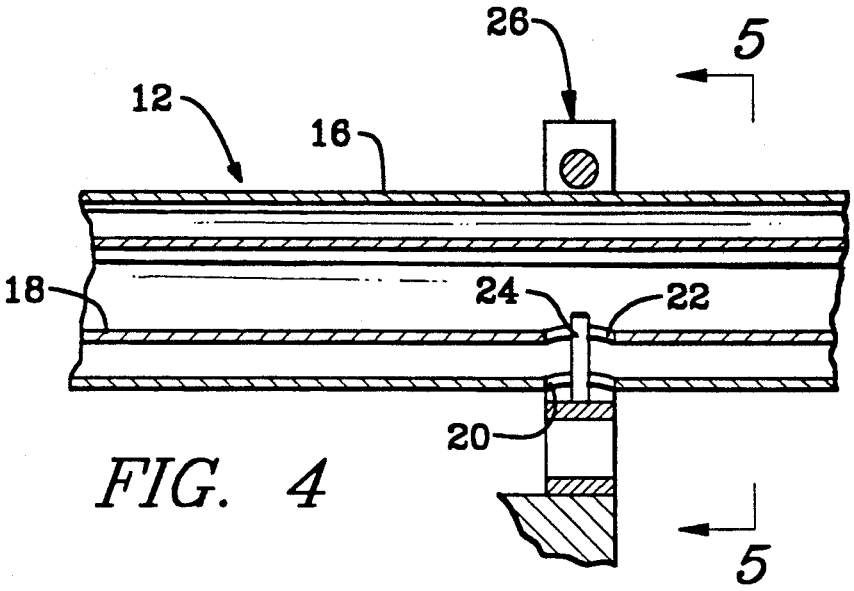
FIG. 4 is an exploded cross sectional view illustrating the of FIG. 1.
Figure 5:
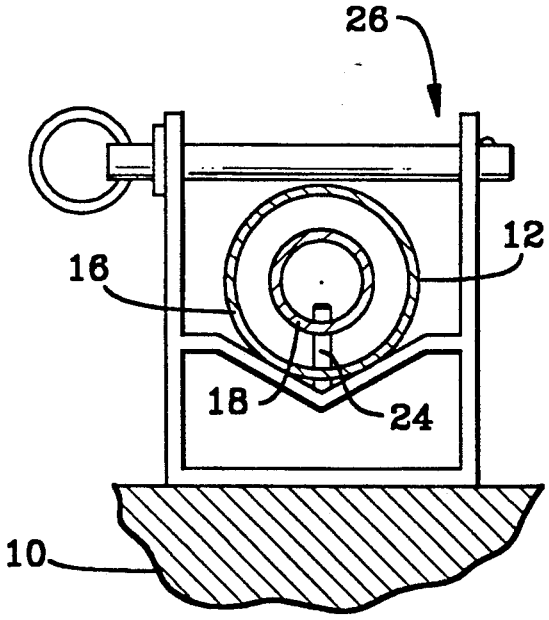
FIG. 5 is a partial cross sectional view as taken along sectional lines 5—5 of FIG. 4.

A vehicle 10 has a telescoping tower 12 pivotally attached thereto via pivoting means 14. The telescoping tower may be pivoted between a stored position (illustrated in FIG. 1) and a usable position (illustrated in FIGS. 2 and 3).

The tower 12 comprises first and second tubular tower members 16, 18. The second tubular tower member 18 is smaller in diameter than, and telescopingly mounted within, the first tubular tower member 16. When the tower is in the usable position it may be displaced between a telescopingly extended position (illustrated in FIG. 3), and a telescopingly retracted position (illustrated in FIG. 2).

The tower 12 is extended and retracted by a well-known actuator 17 which may be a fluid actuated device, a wire hoisting device, manually or any other actuator commonly used to extend and retract telescoping towers.

Often in such towers, the same actuators which move the telescoping tubular members between the retracted and extended positions are also used to retain the tower in the stored position. If this actuator fails while the tower is in the stored position in the prior art telescoping towers, especially if the tower is attached to a moving vehicle, then one of the tubular members may uncontrollably extend relative to the other tubular member. According to the present invention, additional means are provided to limit such extension of the tower.

Accordingly, a first aperture 20 is formed in the first tubular tower member 16 and a second aperture 22 is formed in the second tubular tower member 18. When the tower 12 is in the retracted position, the first aperture 20 is aligned with the second aperture. When the tower is pivoted about pivoting means 14 into the stored position, a lock means such as a rod member 24 is connected to vehicle 10 and is inserted into and extends through the first and the second apertures 20, 22. Thus, lock means 24 limits relative displacement of the tower members.

A securing means 26 retains the tower 12 in the stored position and limits disengagement between the lock means 24 and the apertures 20, 22. The lock means 24 also restricts excess lateral motion between the tower 12 and the vehicle 10 (this later motion may otherwise be permitted by the securing means).

While this disclosure has been applied to a telescoping tower with two tubular members, it is to be understood that it can also be applied to a tower of three or more tubular members.

While this invention has been illustrated and described in accordance with a preferred embodiment, it is recognized that variations and changes may be made therein without departing from the invention as set forth in the claims.

Having described the invention, what is claimed is:

1. An apparatus, associated with a vehicle, comprising:

a telescoping tower having a first tubular tower member and a second tubular tower member which are relatively telescoped between an extended position and a retracted position;

the first tubular tower member having a first aperture formed therein;

the second tubular tower member having a second aperture formed therein, the second aperture being aligned with the first aperture when the tower is in the retracted position;

pivoting means, attached to the vehicle, for pivotally mounting the telescoping tower between a stored and a usable position when the tower is in the retracted position; and lock means, comprising a rod member attached to the vehicle, the lock means capable of being inserted in said first and second aligned apertures, when the first and the second tubular tower means are positioned in said stored position, for limiting relative displacement of the first and the second tubular tower members.

2. The apparatus as described in claim 1, wherein the lock means is removed from the first and the second aperture when the tower is pivoted to the usable position.

3. The apparatus as described in claim 1, further comprising:

securing means for retaining the tower in the stored position.

4. The apparatus as described in claim 1, wherein the lock means permits relative displacement between the tubular tower members when the tower is pivoted into said usable position.

5. The apparatus as described in claim 1, wherein said lock means permits pivoting of said tower into the stored position only when the tower is in the retraced position.

6. An apparatus, associated with a vehicle, comprising:

a telescoping tower having a first tubular tower member and a second tubular tower member which are relatively telescoped between an extended position and a retracted position;

a first tubular tower member having a first aperture formed therein;

a second tubular tower member having a second aperture formed therein, the second aperture being aligned with the first aperture when the tower is in the retracted position;

pivoting means for pivotally mounting the telescoping tower between a stored and a usable position when the tower is in the retracted position; and a lock insertable into both the first and the second apertures when the tower is in said stored position, the lock being attached to the vehicle.

7. The apparatus as described in claim 6, wherein the pivoting means is attached to the vehicle.

8. The apparatus as described in claim 6, wherein the lock comprises:

a rod connected to the vehicle.

9. The apparatus as described in claim 6, wherein the lock is removed from the first and the second apertures when the tower is pivoted to the usable position.

10. The apparatus as described in claim 6, further comprising:

securing means for retaining the tower in the stored position.

11. The apparatus as described in claim 7, wherein the lock is affixed to the vehicle.

12. The apparatus as described in claim 6, wherein the lock limits relative motion between the first tubular tower member and the second tubular tower member.

13. The apparatus as described in claim 6, wherein the lock is removed from the first and second aperture when the tower is pivoted into said usable position.

14. The apparatus as described in claim 6, wherein said lock permits pivoting of said tower into the stored position only when the tower is in the retracted position.

* * * * *